United States Patent [19]

Suzuki et al.

[11] 4,353,396

[45] Oct. 12, 1982

[54] DEVICE FOR FORMING A SELVEDGE IN A LOOM

[75] Inventors: Hajime Suzuki, Anjo; Yoshimi Iwano, Oobu, both of Japan

[73] Assignee: Kabushiki Kaisha Toyoda Jidoshokki Seisakusho, Aichi, Japan

[21] Appl. No.: 100,286

[22] Filed: Dec. 5, 1979

[30] Foreign Application Priority Data

Dec. 11, 1978 [JP] Japan ..... 53-170490[U]
Dec. 29, 1978 [JP] Japan ..... 53-182596[U]

[51] Int. Cl.[3] ..... D03D 47/00
[52] U.S. Cl. ..... 139/54
[58] Field of Search ..... 139/54, 429, 430

[56] References Cited

U.S. PATENT DOCUMENTS 3,596,685 8/1971 Bassart ..... 139/429
3,794,083 2/1974 Czelusniak ..... 139/54
3,880,199 4/1975 Riha et al. ..... 139/54
4,077,438 3/1978 Tanaka et al. ..... 139/429
4,193,427 3/1980 Shindo et al. ..... 139/54

*Primary Examiner*—Henry Jaudon
*Attorney, Agent, or Firm*—Burgess, Ryan and Wayne

[57] ABSTRACT

A loom comprises: a machine frame; heald frames for supporting ground heddles of warps; and a device for forming a selvedge. The device for forming a selvedge includes: a rotatable member which is rotated by a power transmitting mechanism; and a pair of selvedge yarn guides which are attached to said rotatable member and which are utilized to withdraw the selvedge yarns. The device for forming a selvedge is disposed at the side of the machine frame and behind the heald frames. The selvedge yarns are open and closed in synchronism with the shedding motion of the warps and are formed into a selvedge by twisting the selvedge yarns at every weaving. The device for forming a selvedge is adjustable in a lengthwise and vertical direction of the machine frame.

7 Claims, 8 Drawing Figures

DEVICE FOR FORMING A SELVEDGE IN A LOOM

BACKGROUND OF THE INVENTION

The present invention relates to a device which forms the selvedge of a woven fabric and is disposed in a loom.

U.S. Pat. No. 3,320,978 discloses a device for forming a selvedge which comprises a rotatable member and two guides for guiding yarns for the selvedge mounted on the rotatable member. As the rotatable member rotates, the selvedge yarn guides rotate on their axes and revolve. As a result, the two selvedge yarns are open and closed and they are twisted at every weaving.

The above-mentioned conventionally known device for forming a selvedge wherein the selvedge yarns are open and closed by the rotational movement of the rotatable member and are twisted at every weaving is disposed immovably in any direction, i.e., along the lengthwise direction, the vertical direction and the widthwise direction of the machine frame, and the device is disposed at a position which corresponds to the maximum number of the heald frames. In other words, even if the number of the heald frames is changed, the position of the device for forming the selvedge cannot be changed. Accordingly, the forwardmost position of the droppers which are disposed behind the device for forming the selvedge is limited, and the backward closed position of the warps is determined on the basis of the limited forward position of the droppers regardless of the number of the heald frames. As a result, if the number of the heald frames is decreased, an unnecessary space is formed between the heald frames and the device for forming the selvedge. In addition, the distance between the backwardmost heald frame and the cloth fell becomes unequal to the distance between the backwardmost heald frame and the backward closed position of the warps. As a result, the tension in the warps cannot be adjusted appropriately, and a woven fabric which has an inferior weave and hand is produced.

Since in such a conventional device for forming a selvedge the positions where the selvedge yarn bobbins are supported are also limited, the opening angle between the selvedge yarns is constant if the device for forming a selvedge is disposed at a certain position. Accordingly, the opening angle between the selvedge yarns is not necessarily equal to the opening angle formed between the ground warps. In a loom, such as a jet loom, wherein the front end of the weft is free, the selvedge yarn may interfere with the weft, and as a result, weft stop may occur. It should be noted that the weft is woven at will in accordance with the weaving condition along the lower warps or along the upper warps while the warps are open. For example, when the device for forming a selvedge is disposed so that the selvedge yarn is open in alignment with the lower warps of the ground warps, the upper selvedge yarn interferes with the weft and weft stop frequently occurs if the weaving position is changed in order to weave the weft along the upper warps. In addition, in a loom wherein the device for forming a selvedge is disposed behind the heald frames for supporting ground heddles, it is necessary that the position of the device for forming a selvedge be changed when the number of the heald frames for supporting ground heddles is changed. In such a case, the opening angle between the selvedge yarns may be changed as the position of the device is changed. If the number of the heald frames for supporting ground heddles is increased, the device for forming a selvedge is displaced away from the heald frames, and then the opening angle between the selvedge yarns becomes small. As a result, there occurs the interference of the selvedge yarn with the woven weft because of the reason mentioned above, and in addition, the interference of the selvedge yarn with the woven weft, for example, the lower selvedge yarn per se is positioned higher than the lower warps of the ground warps. To improve the weave and hand of the obtained woven fabric, in some looms, the warps are closed at a position higher than the warp line, and in some looms, the warps are closed at a position lower than the warp line. However, it should be noted that since in the above-mentioned conventional device for forming a selvedge the selvedge yarns are open by means of the rotational movement of the rotational member, the selvedge yarns are closed at a position near the warp line. In other words, the height of the closed position of the selvedge yarns is different from the height of the closed position of the ground warps, and as a result, the formation of the selvedge is adversely affected. For example, when the warps are closed at a position lower than the warp line, if the conventional device for forming a selvedge is disposed in order to close the selvedge yarns at a position lower than the warp line, it is impossible to overcome the change of the warping condition wherein the ground warps are closed at a position higher than the warp lines.

SUMMARY OF THE INVENTION

An object of the present invention is to provide a device for forming a selvedge mounted in a loom which device is disposed adjustably with respect to the machine frame of the loom so that the device can be utilized under various weaving conditions.

In a preferred embodiment of the present invention, the device for forming a selvedge is disposed adjustably in the lengthwise direction of the machine frame. Accordingly, as the number of the heald frames for supporting the ground heddles is changed, the distance between the backwardmost heald frame and the cloth fell can be substantially equal to the distance between the backwardmost heald frame and the backward closed position of the warps. As a result, a woven fabric having a good weave and hand can be produced regardless of an increase or decrease in the number of the heald frames. In addition, the weaving operation can be ensured by the device.

In another preferable embodiment of the present invention, the device for forming a selvedge is also disposed vertically adjustably on the machine frame. Accordingly, the open shed and closed position of the selvedge yarns can also be adjusted vertically at will. As a result, the interference of the selvedge yarn with the woven weft is completely prevented.

BRIEF DESCRIPTION OF THE DRAWINGS

Some embodiments of the present invention will now be explained with reference to the accompanying drawings, wherein.

DETAILED DESCRIPTION OF THE INVENTION

Figure 1:
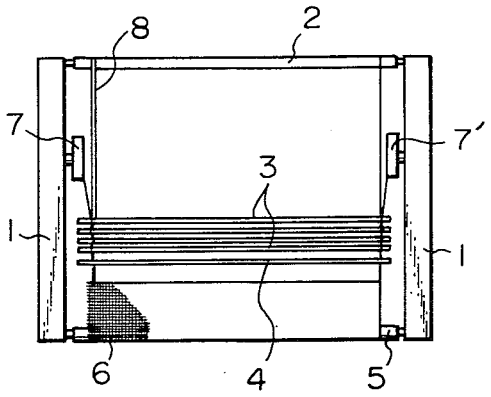
FIG. 1 is a plan view of a loom according to the present invention.

A first embodiment wherein the present invention is realized will be explained hereinbelow in detail with reference to FIGS. 1 through 4. Referring to FIG. 1, a loom comprises a machine frame 1, a back roller 2, heald frames 3, reeds 4, prestress roller 5 and a pair of devices 7 and 7' for forming a selvedge. The devices 7 and 7' are disposed at the side of the machine frame 1 so as to be located at the sides of warps 8, respectively.

Figure 3:
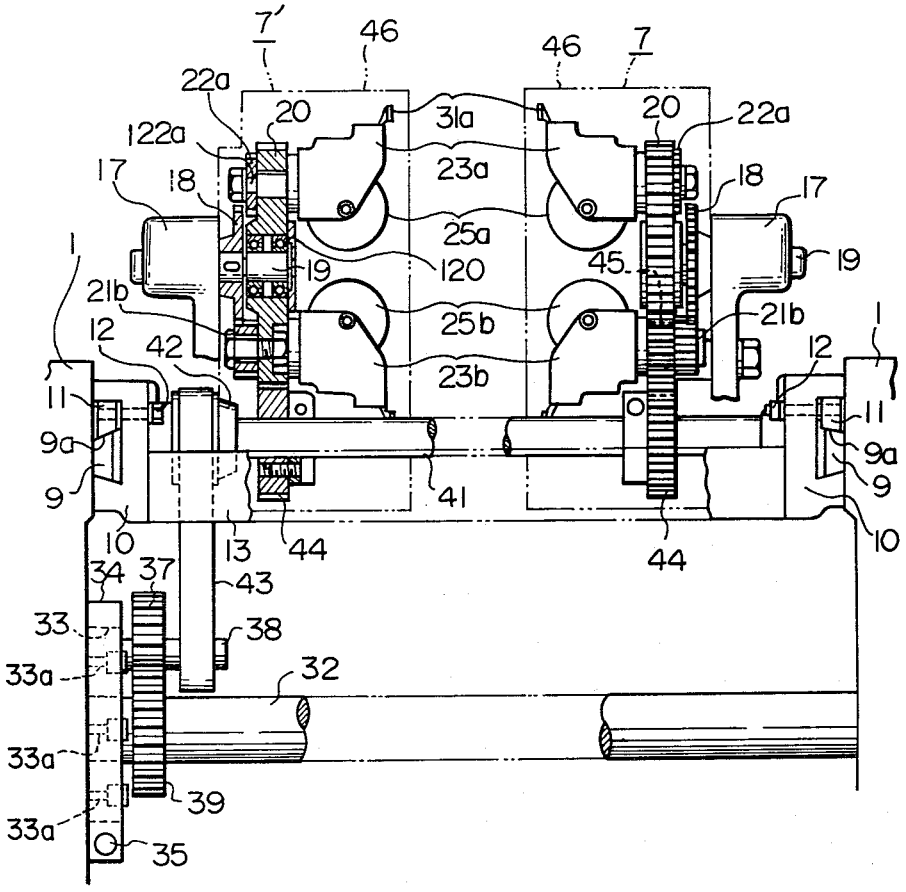
FIG. 3 is a cross sectional side view of the device illustrated in FIG. 2.
Figure 4:
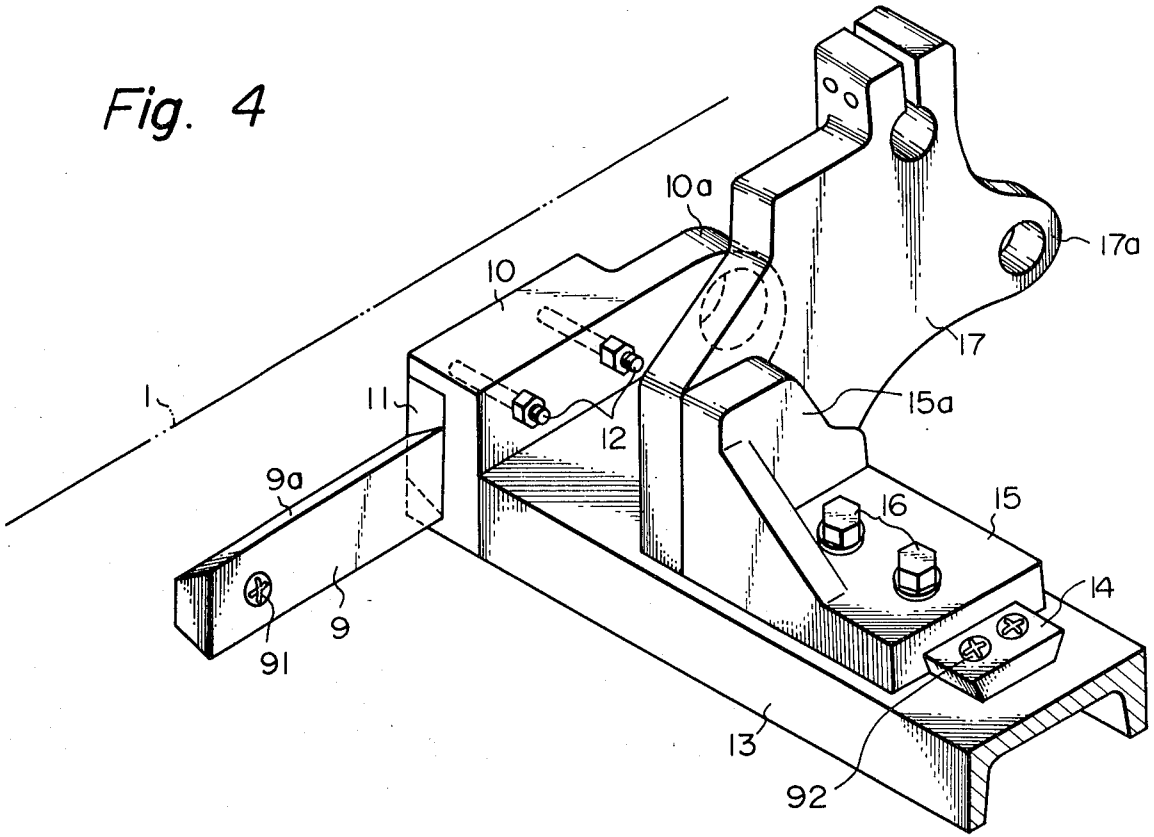
FIG. 4 is an enlarged perspective view which illustrates the mounting structure of the device illustrated in FIG. 2.

Referring to FIGS. 3 and 4, a pair of guide rails 9 have a dovetail shape and are fastened to the inside of the machine frame 1 by means of machine screws 91 (FIG. 4) so that they extend in a direction along the lengthwise direction of the machine frame 1, i.e., in a direction perpendicular to the sheet on which FIG. 3 is illustrated, and so that they face each other. Adjusting members 10 are engaged with the guide rails 9 so that they can slide along the guide rails 9. The inner upper portions of the adjusting members 10 have fastening members 11 inserted therein which have dovetailed engaging surfaces abuting with the upper dovetailed surfaces 9*a* of the guide rails 9. Bolts 12 are inserted into the fastening members 11 from the outside and are threaded so that the engaging surfaces of the fastening members 11 are brought into abutment with the dovetailed surfaces 9*a* and so that the adjusting members 10 can be fixed at a desired position.

Supporting beam 13 for supporting devices 7 and 7' for forming a selvedge extends between the adjusting members 10, and it is fixed on the adjusting members 10. In FIG. 4, both ends (only one end is illustrated in FIG. 4) of the supporting beam 13 have guide rails 14 having a dovetailed shape secured thereon by means of machine screws 92 so that the guide rails 14 extend in a widthwise direction of the machine frame 1. A pair of attaching members 15 (only one is illustrated in FIG. 4) is slidably inserted onto the guide rails 14 so that they can slide along the widthwise direction of the loom. Two set bolts 16 are threaded into the upper surfaces of the attaching members 15 so that the attaching members 15 can fixedly be secured to the guide rails 14. Referring to FIGS. 3 and 4, brackets 17 are fixed to the side walls 15*a* of the attaching members 15. The side surfaces of the brackets 17, which surfaces face each other, have the devices 7 and 7' for forming a selvedge mounted thereon.

Figure 2:
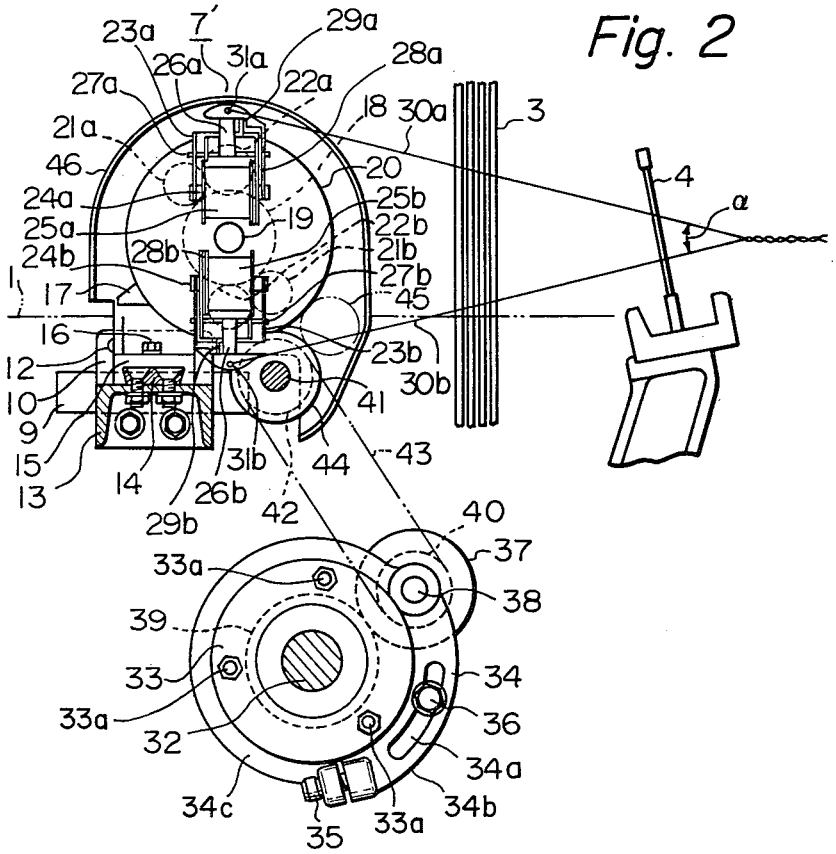
FIG. 2 is an enlarged elevational view of the device for forming a selvedge mounted on the loom illustrated in FIG. 1.

The device 7 and 7' for forming a selvedge and mounted on the brackets 17 will now be explained with reference to FIGS. 2 and 3. Stationary shafts 19 are inserted into the upper portion of the brackets 15 and are secured to the brackets 15. A sun gear 18 is secured to the stationary shaft 19 by means of a key (not shown), and a carrier 20 is rotatably supported on the stationary shaft 19 by means of a bearing 120 (FIG. 3). Planetary intermediate gears 21*a* (FIG. 2) and 21*b* are located at diametrically opposed positions around the carrier 20 and mesh with the sun gear 18. Planetary gears 22*a* and 22*b* meshing with the planetary intermediate gears 21*a* and 21*b* are supported on pins 122*a* (FIG. 3) at diametrically opposed positions around the sun gear 18. Bobbin holders 23*a* and 23*b* are secured to the pins 122*a* of the planetary gears 22*a* and 22*b* and are rotated together with the planetary gears 22*a* and 22*b* as one body. In FIG. 2, shafts 24*a* and 24*b* rotatably support selvedge yarn bobbins 25*a* and 25*b*.

L-shaped bobbin stop levers 26*a* and 26*b* are supported rotatably about shafts 27*a* and 27*b* which are fixedly connected to the bobbin holders 23*a* and 23*b*. One end of the bobbin stop levers 26*a* and 26*b* has Y shaped notches, and the other ends of the bobbin stop levers 26*a* and 26*b* have hooks which engage with ratchets 28*a* and 28*b* disposed at the side of the selvedge yarn bobbins 25*a* and 25*b*. Return bars 29*a* and 29*b* are similarly supported rotatably about the shafts 27*a* and 27*b* and are urged in one direction by means of springs (not shown) so that a predetermined tension is applied to the selvedge yarns.

The selvedge yarns 30*a* and 30*b* withdrawn via the selvedge yarn guides 25*a* and 25*b* contact with the fixed shafts 27*a* and 27*b*, and then they contact with the Y-shaped notches formed on the bobbin stop levers 26*a* and 26*b* and are deflected. After the selvedge yarns 30*a* and 30*b* are turned back, they pass through the upper portion of the notches formed on the bobbin stop levers 26*a* and 26*b*, and then they are withdrawn through yarn guides 31*a* and 31*b* which are disposed on the bobbin holders 23*a* and 23*b*. The selvedge yarns 30*a* and 30*b* are subjected to a shedding motion and twisting motion and they, together with the weft which has been woven while the selvedge yarns have been open, form selvedge.

Power transmitting mechanism operates the devices 7 and 7' for forming a selvedge and is capable of adjustment of its position in accordance with the vertical or horizontal adjustment of the devices 7 and 7' for forming selvedge. Referring to FIG. 3, a drive shaft 32 is supported on machine frame 1 positioned at the left and right by means of bearings (not shown), and the drive shafts 32 is rotated in synchronism with the weaving operation. Mounting ring 33 comprising a circular disc is rotatably supported on the drive shaft 32 by a bearing (not shown) and is secured to the inside of the left machine frame 1 by bolts 33*a*. A split position adjusting ring 34, the inner diameter of which is slightly larger than the outer diameter of the mounting ring 33, is rotatably placed over the outer surface of the mounting ring 33. The periphery of the position adjusting ring 34 is split into two arcuate portions 34*b* and 34*c* as illustrated in FIG. 2 in order to provide a compression fit over the mounting ring 33 as described below. Position adjusting ring 34 has a fastening bolt 35, one end of which is threaded in one portion of the periphery of the ring 34*b* and the base portion of which is rotatably supported by the other portion 34*c* of the periphery of said ring. When the fastening bolt 35 is turned tightly, the diameter of the adjusting ring 34 is decreased and the adjusting ring 34 is compressed to the outer surface of the mounting ring 33 so as to be secured thereto. In FIG. 2, the outer flange of the adjusting ring 34 has an arc shaped elongated hole 34*a*, and another fastening bolt 36 is inserted into the elongated hole 34*a* so that the adjusting member 34 is urged to the inner surface of the machine frame, and secured thereto.

In FIGS. 2 and 3, a rotatable shaft 38 has a gear 37 fixed thereto and is rotatably supported on the outer flange of the adjusting ring 34. The gear 37 meshes with a gear 39 fixedly secured to the drive shaft 32. In FIG. 2, a timing belt pulley 40 is fixed on the rotatable shaft 38. A rotatable shaft 41 is rotatably supported on a bearing portion 10*a* (FIG. 4) integrally formed at the front end of the adjusting member 10. The shaft 41 has a timing belt pulley 42 fixed thereon. A timing belt 43 is engaged with the timing belt pulleys 40 and 42. A gear 44 is fixed on the rotatable shaft 41 and meshes with the gear surface of the carrier 20. The gear 44 is slidable on the rotatable shaft 41 along the axial direction so that the position of the gear 44 can be adjusted on the rotatable shaft 41.

An intermediate gear 45 (FIG. 2) is rotatably supported in a bearing portion 17*a* which is formed integrally with the front end of the bracket 17 as illustrated in FIG. 4, and as illustrated by a two-dot dash line in FIG. 2, it meshes with the gear 44 and the carrier 20 mounted on the device 7′ for forming a selvedge. In FIG. 3, the intermediate gear 45 serves to rotate the carriers 20 of the devices 7 and 7′ for forming a selvedge in directions opposite to each other. Reference numeral 46 denotes a cover of the devices 7 and 7′ for forming a selvedge.

The operation of the devices for forming selvedge thus obtained will now be explained. In FIGS. 2 and 3, when the drive shaft 32 is rotated, its rotational movement is transmitted to the device 7 for forming a selvedge through the gears 39 and 37, the shaft 38, the drive timing belt pulley 40, the timing belt 43, the driven timing belt pulley 42, the rotational shaft 41 and the gear 44, and then it is transmitted to the other device 7′ for forming a selvedge via the gear 44 and the intermediate gear 45, and as a result the selvedge is formed. Since the devices 7 and 7′ for forming a selvedge are oppositely disposed and since the rotating direction of the gear 44 of the device 7 for forming a selvedge is opposite to the rotating direction of the intermediate gear 45 of the device 7′ for forming a selvedge, the rotational directions of the carriers 20 of the devices 7 and 7′ for forming selvedge become opposite to each other. As a result, the two pairs of selvedge yarns withdrawn from the devices 7 and 7′ for forming a selvedge are twisted in the same direction, and the selvedge yarns per se are also subjected to twisting. The selvedge yarns do not become weak when they are subjected to the selvedge forming operation because the twists therein do not vanish.

When the weaving condition must be changed and the number of the heald frames is increased or decreased, the fastening bolts 35 and 36 of the position adjusting ring 34 are unfastened, and the bolt 12 of the adjusting member 10 is also unfastened, and then the support beam 13 together with the devices 7 and 7′ are displaced in the lengthwise direction of the loom, i.e., in a direction perpendicular to the sheet on which FIG. 3 is illustrated, and the bolts 35, 36 and 12 are fastened again. When the number of the heald frames is decreased, the devices 7 and 7′ for forming the selvedge displaced toward the heald frames. On the contrary, when the number of the heald frames is increased, the devices 7 and 7′ are displaced away from the heald, frames. Accordingly, the position of the droppers can be adjusted, and the distance between the backwardmost heald frame and the cloth fell can be substantially the same as the distance between the backwardmost heald frame and the backward closed position of the warps. As a result, a woven fabric having a good veave and hand can be produced.

In a conventional device for forming a selvedge, the device is positioned at a certain location behind the heald frames which is determined based on the weaving condition that the number of the heald frames is at a maximum, and the opening angle between the selvedge yarns is constant. On the other hand, according to the device illustrated in FIGS. 1 through 4, the location of the devices 7 and 7′ for forming a selvedge can be adjusted in the lengthwise direction of the loom and the opening angle can be larger if it is required. As a result, the weft stop caused by the interference between the weft and the selvedge yarn can be prevented.

The adjustment of the devices 7 and 7′ for forming a selvedge in the widthwise direction of the loom can be effected by unfastening the set bolts 16 of the attaching member 15. At the same time, the location of the gear 44 is also adjusted so that the gear continuous to be engaged with the carrier 20.

Figure 5:
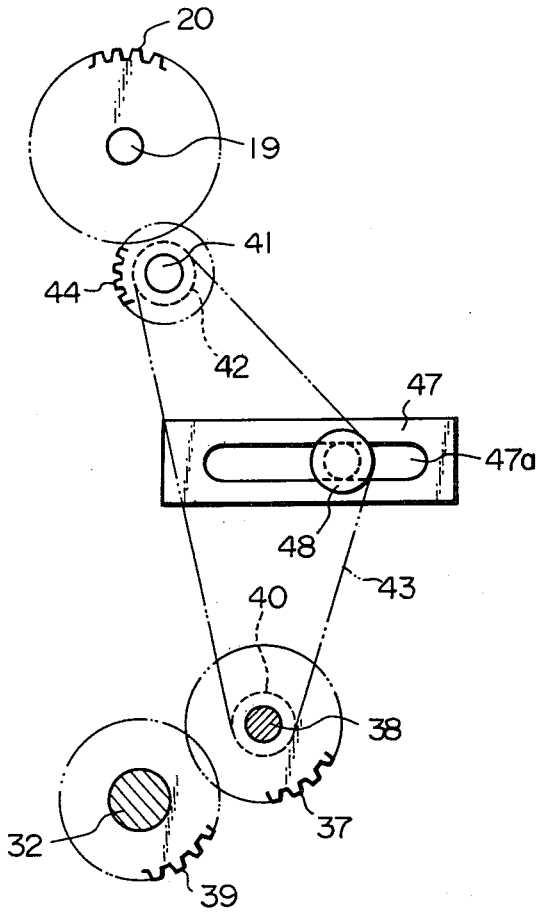
FIG. 5 is a diagrammatical elevational view of a power transmitting mechanism.

In the foregoing embodiment, to facilitate the locational adjustment of the devices for forming a selvedge in the lengthwise direction of the loom, the mounting ring 33 has the position adjusting ring 34 engaged therewith. Instead of the mounting ring 33 and the adjusting ring 34 which are illustrated in FIG. 2, as illustrated in FIG. 5, it is possible to dispose a guide member 47 which has an elongated hole 47*a* on the machine frame, and mount a timing belt pulley 48 in the elongated hole 47*a*, which pulley 48 is adjustable along the elongated hole 47*a* and with which pulley the timing belt 43 is engaged.

As mentioned above the embodiments of the present invention illustrated in FIGS. 1 through 5 are located at the side of the warps and behind the heald frames for supporting ground heddles and are constructed so that a pair of selvedge yarns withdrawn through a pair of selvedge yarn guides attached to a rotatable member which is rotated by a power transmitting mechanism are open and closed in synchronism with the shedding motion of the warps and are twisted to form a selvedge at every weaving of the weft. The location of the devices for forming a selvedge relative to the cloth fell can be adjusted. Accordingly, in accordance with the changes in the number of the heald frames, the distance between the backwardmost heald frame and the cloth fell can be adjusted to be almost equal to the distance between the backwardmost heald frame and the backward closed position of the ground warps. As a result, a woven fabric which has an excellent weave and hand can be obtained regardless of the number of the heald frames, and the efficiency of the weaving operation is enhanced.

Figure 6:
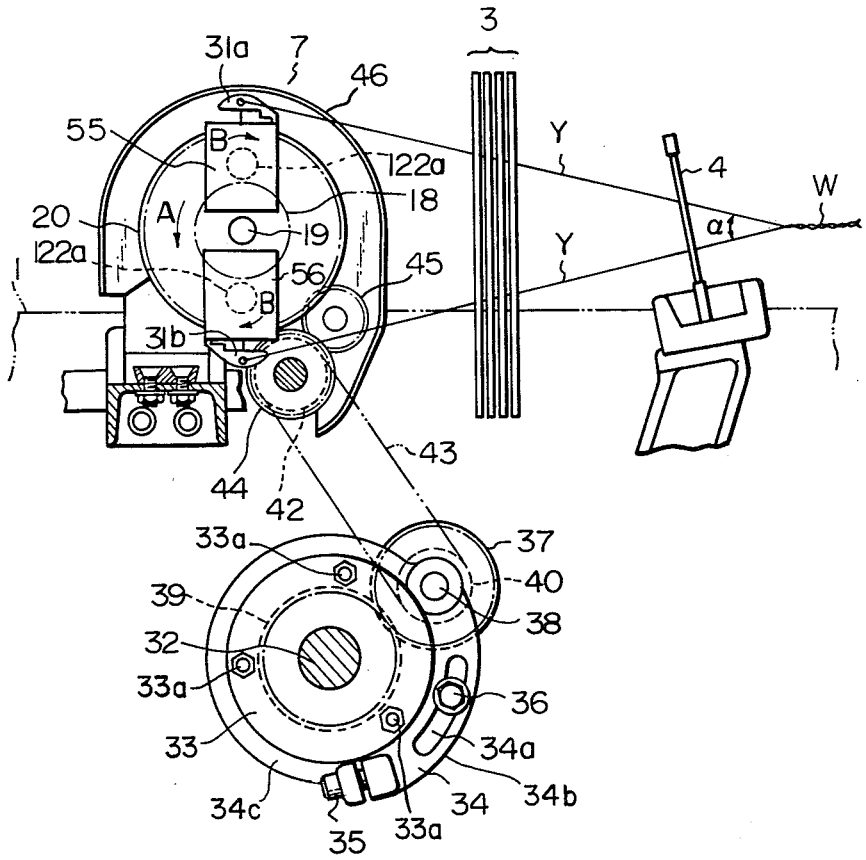
FIG. 6 is an enlarged elevational view of another device for forming a selvedge according to the present invention.

In actual weaving operations, it may be often required to vertically adjust the selvedge yarns in conjunction with the warps, for example, when the number of the heald frames is changed and the device for forming a selvedge is displaced along the lengthwise direction of the machine frame by utilizing the above-explained embodiments or when the location of the selvedge yarns relative to the woven weft is required to be vertically changed as explained above. Another embodiment of the present invention which will satisfy the requirement above will now be explained. In FIG. 6, the device 7 for forming a selvedge is diagrammatically illustrated and includes a shaft 19 fixedly secured to a bracket 17 (FIG. 7) and the shaft 19 carries a carrier 20. Two frame members 55 and 56 which accomodate selvedge yarn bobbins (not shown in FIG. 6) are rotatably supported on the side surface of the carrier 20. The frame members 55 and 56 have selvedge yarn guides 31*a* and 31*b*, respectively. The carrier 20 is operably interconnected with a gear 39 mounted on a drive shaft 32 via an intermediate gear 45, a gear 44, a driven timing belt pulley 42, a timing belt 43, a drive timing belt pulley 40 and a gear 37 so that the carrier 20 is rotated. When the carrier 20 is rotated, since gears and idle gears (not shown in FIG. 6) mounted on shafts 122*a* of the frame members 55 and 56 mesh with the sun gear 18 attached to the shaft 19, the frame members 55 and 56 are revolved in a direction denoted by the arrow A together with the carrier 20 and are rotated around their own axes in a direction which is opposite to the above-mentioned direction denoted by arrow A and which is denoted by the arrow B. Accordingly, the selvedge yarn guides 31*a* and 31*b* vertically reciprocate along a vertical line which passes through the axis of the shaft 19 so that the selvedge yarns Y withdrawn from the selvedge yarn bobbins are open and closed and are twisted due to the rotational movement of the selvedge yarn guides 31*a* and 31*b*.

The construction of the power transmitting mechanism is substantially the same as that explained with reference to FIG. 2. Accordingly, the like parts are denoted by the like reference numerals and their further explanation is omitted here.

Figure 7:
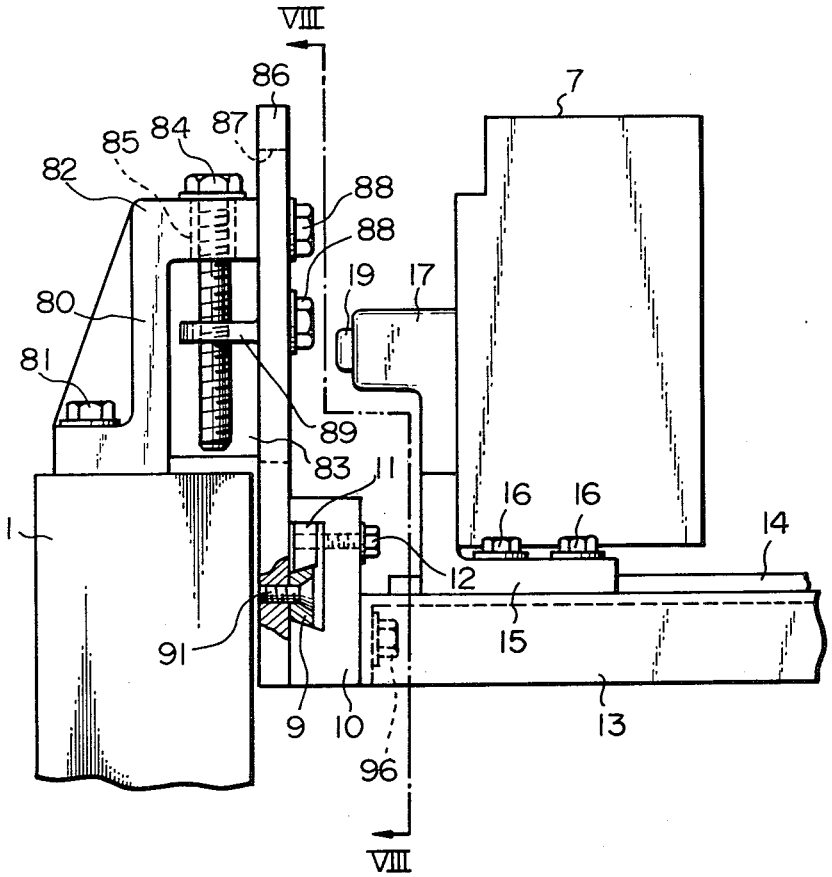
FIG. 7 is a side view of the device illustrated in FIG. 6.
Figure 8:
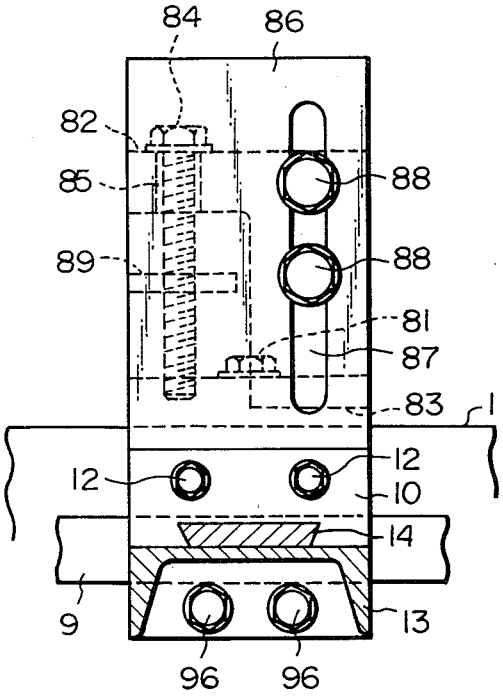
FIG. 8 is a cross sectional view taken along line VIII—VIII in FIG. 7.

Referring to FIG. 7, a bracket 80 is fixed on the machine frame 1 by means of bolts 81. The bracket 80 comprises a head portion 82 which projects to the right in FIG. 6 and a surface 83 which hangs down from the head portion 82. The head portion 82 has a through hole 85 for inserting an adjusting bolt 84. In FIG. 8, a mounting member 86 has an elongated hole 87 and is fixedly secured to the front surface of the bracket 80 by means of two bolts 88 inserted into the elongated hole 87. Referring to FIG. 7 again, the mounting member 86 has a horizontal adjusting plate 89 projected from the mounting member 86 toward the bracket 80. The adjusting bolt 84 threadedly engages with the adjusting plate 89.

The inner side surface of the machine frame 1 has guide rails 9 and adjusting members 10 which are constructed in the foregoing manner explained with reference to FIG. 3. A support member 13 is disposed between the adjusting members 10 by means of bolts 96 in the foregoing manner explained with reference to FIG. 4, and a pair of attaching members 15 is slidably carried on guide rails 14 which are mounted on the support member 13.

When the opening of the selvedge yarns must be aligned with the lower warps of the ground warps, the bolt 88 is unfastened and the adjusting bolt 84 which has been inserted through the hole 85 of the bracket 80 and which has been threaded with the adjusting plate 87 of the mounting member 86 is turned in a predetermined direction, for example counterclockwise, the mounting member 86 is lowered. When the mounting member 86 is lowered to a desired position, the bolt 88 is fastened again and the mounting member 86 is fixedly secured to the bracket. The positioning operation of the mounting member can be highly facilitated by forming graduations on the bracket 80 and the mounting member 86. As a result, the devices 7 mounted on the mounting member 86 is positioned at a lowered location, and the selvedge yarns are open in a desired condition by mean of the devices 7. When it is desired that the open selvedge yarns be aligned with the upper warps of the ground warps, in the foregoing manner, the adjusting screw is turned in a direction, for example, clockwise and the location of the devices 7 for forming a selvedge can easily be adjusted.

According to the embodiment of the present invention, two selvedge yarn bobbins are rotatably mounted on a rotatable member, and because of the rotation of the rotatable member, the selvedge yarns withdrawn from the selvedge yarn bobbins move vertically to effect the shedding operation. The embodiment is characterized in that the device for forming a selvedge can be adjusted vertically at the side of the machine frame. Accordingly, the vertical location of the device for forming a selvedge is freely and easily adjusted, and the selvedge yarns can be opened at will in alignment with the upper or lower warps of the ground warps. As a result, the interference of the selvedge yarn with the woven weft which may occur due to the difference in opening angles of the selvedge yarns and the ground warps can be prevented.

It should be understood that the present invention can be applicable to any kind of shuttleless looms, such an a water or air jet loom, a rapier loom or a gripper loom within the scope of the present invention.

What we claim is:

1. A loom comprising:

a machine frame;

heald frames for supporting ground heddles of warps; and a device adjustably disposed relative to said machine frame for forming a selvedge which is disposed behind said heald frames and which includes:

a power transmitting mechanism;

a rotatable member which is rotated by said power transmitting mechanism;

a pair of selvedge yarn guides which are attached to said rotable member and which are utilized to withdraw selvedge yarns, whereby said selvedge yarns are opened and closed in synchronism with the shedding motion of said warps and are formed into a selvedge by being twisted together at every weaving, said device being displaceable along the warp running direction normal to the heald frames of said machine frame and capable of being fixedly secured at a certain position;

a pair of dovetailed guide rails fixedly disposed at the inside of said machine frame so as to face each other and extending in the warp running direction of said machine frame; and a pair of slide beams slidably disposed on said guide rails, and capable of being fixedly secured thereto, said device for forming a selvedge being mounted on said slide beams.

2. A loom according to claim 1, wherein said defice for forming a selvedge is vertically adjustable.

3. A loom according to claim 2, further comprising: a pair of brackets which are mounted on said machine frame; mounting members which carry said device for forming a selvedge and which are vertically slidable along said brackets; and adjusting members which are disposed on said brackets and which vertically adjust the position of said mounting members relative to said brackets.

4. A loom comprising:

a machine frame;

heald frames for supporting ground heddles of warps; and a device adjustably disposed relative to said machine frame for forming a selvedge which is disposed behind said heald frames and which includes:

a power transmitting mechanism;

a rotatable member which is rotated by said power transmitting mechanism; and a pair of selvedge yarn guides which are attached to said rotatable member and which are utilized to withdraw selvedge yarns, whereby said selvedge yarns are open and closed in synchronism with the shedding motion of said warps and are formed into a selvedge by being twisted together at every weaving, said power transmitting mechanism comprising:

a drive shaft which is disposed at a certain position and which rotates in synchronism with said shedding motion of said warps;

a mounting ring coaxially inserted onto said drive shaft and fixedly fastened to said machine frame;

an adjusting ring turnably and adjustably engaged with the outer surface of said mounting ring;

a driven gear which engages with a drive gear attached to said drive shaft and which is rotatably disposed on one end of said mounting ring, and a timing belt pulley which is driven by said driven gear and which transmits driving power to said devices for forming a selvedge via a timing belt.

5. A loom comprising:

a machine frame;

heald frames for supporting ground heddles of warps; and a device adjustably disposed relative to said machine frame for forming a selvedge which is disposed behind said heald frames and which includes:

a power transmitting mechanism;

a rotatable member which is rotated by said power transmitting mechanism; and a pair of selvedge yarn guides which are attached to said rotatable member and which are utilized to withdraw selvedge yarns, whereby said selvedge yarns are open and closed in synchronism with the shedding motion of said warps and are formed into a selvedge by being twisted together at every weaving, said power transmitting mechanism comprising:

a first timing belt pulley which is disposed at a certain position and which rotates in synchronism with said shedding motion of said warps;

a second timing pulley which is disposed adjustably and slidably along the lengthwise direction of said machine frame; and a timing belt which engages with said first and second timing pulleys so as to transmit power to said devices for forming selvedge.

6. A loom comprising:

(A) a machine frame;

(B) heald frames for supporting ground heddles of warps;

(C) a vertically adjustable device for forming a selvedge which is disposed behind said heald frames and which includes:

(1) a power transmitting mechanism, (2) a rotatable member which is rotated by said power transmitting mechanism, and (3) a pair of selvedge yarn guides which are attached to said rotatable member and which are utilized to withdraw selvedge yarns;

(D) a pair of brackets which are mounted on said machine frame;

(E) mounting members which carry said device for forming a selvedge and which are vertically slidable along said brackets; and (F) adjusting members which are disposed on said brackets and which vertically adjust the position of said mounting members relative to said brackets;

whereby said selvedge yarns are opened and closed in synchronism with the shedding motion of said warps and are formed into a selvedge by being twisted together at every weaving.

7. A loom comprising:

(A) a machine frame;

(B) heald frames for supporting ground heddles of warps;

(C) a device adjustably disposed relative to said machine frame for forming a selvedge which is disposed behind said heald frames and which includes:

(1) a power transmitting mechanism, (2) a rotatable member which is rotated by said power transmitting mechanism, (3) a pair of selvedge yarn guides which are attached to said rotatable member and which are utilized to withdraw selvedge yarns, (4) said device being displaceable along the warp running direction normal to the heald frames of said machine frame and capable of being fixedly secured at a certain position, and (5) said device being vertically adjustable;

(D) a pair of brackets which are mounted on said machine frame;

(E) mounting members which carry said device for forming a selvedge and which are vertically slidable along said brackets; and (F) adjusting members which are disposed on said brackets and which vertically adjust the position of said mounting members relative to said brackets;

whereby said selvedge yarns are opened and closed in synchronism with the shedding motion of said warps and are formed into a selvedge by being twisted together at every weaving.

* * * * *